United States Patent [19]

Replogle

[11] 3,949,685

[45] Apr. 13, 1976

[54] AUTOMATIC VACUUM SYSTEM

[75] Inventor: Douglas L. Replogle, Arlington, Mass.

[73] Assignee: Raytheon Company, Lexington, Mass.

[22] Filed: Apr. 2, 1975

[21] Appl. No.: 564,240

[52] U.S. Cl. ..... 110/165 A; 110/49 R

[51] Int. Cl.[2] ..... F23J 1/00

[58] Field of Search..... 110/8 R, 28 F, 28 L, 49 R, 110/165 A

[56] References Cited

UNITED STATES PATENTS

| | | | |
|---|---|---|---|
| 2,518,800 | 8/1950 | Lester, Sr. | 110/28 |
| 3,163,133 | 12/1964 | Montgomery | 110/28 |
| 3,776,149 | 12/1973 | Teich et al. | 110/49 |
| 3,862,609 | 1/1975 | Eff | 110/165 |
| 3,875,875 | 4/1975 | Stenlund | 110/165 |

*Primary Examiner*—Kenneth W. Sprague

*Attorney, Agent, or Firm*—Harold A. Murphy; Joseph D. Pannone; John T. Meaney

[57] ABSTRACT

An automatic suction-type cleaning system for apparatus such as a household incinerator, which system comprises a number of air jets spaced at selected intervals along two walls of a compartment being cleaned and directed toward a single common outlet in one corner of the compartment so as to sweep substantially the entire floor area thereof.

8 Claims, 5 Drawing Figures

AUTOMATIC VACUUM SYSTEM

BACKGROUND OF THE INVENTION

Vacuum systems have been commonly used for the removal of ash and similar residue within an incinerator after a burning cycle is completed. However, many such systems operate in a fashion similar to the conventional home vacuum cleaner wherein an electric motor draws air from the suction end of the device, creating a partial vacuum and simultaneously drawing residue into a suitable container. The air is then discharged at the other end of the system and no further use is made of the kinetic energy of this moving air stream.

Aside from wasted energy, this type of system has an additional disadvantage that the suction force is evenly distributed around the inlet in all directions and cannot be directed toward the matter being picked up except by the use of separate manual means.

The first above-mentioned disadvantage has been at least partially overcome in vacuum cleaning apparatus employing "closed circuit" systems wherein residual matter is picked up an air stream and is removed by a cyclone filter or the like, with the air stream then being redirected back through the system for reuse. However, a serious problem still exists in a closed circuit system of this type. It has been found that when the apparatus is used to clean residue from the bottoms of devices such as incinerators, for example, some of the residue is in the form of relatively large agglomerations of congealed particulate which will not be removed through one or more relatively small suction pipes.

SUMMARY OF THE INVENTION

To minimize or overcome the problems discussed above, this invention provides a vacuum system wherein a single relatively large diameter suction pipe is located in one corner of a rectangular or other controlled shape area to be cleaned. A number of spaced air jets are disposed in walls opposite the pipe and are directed toward the pipe. The jets are arranged to sweep substantially the entire area or surface to be cleaned whereupon the residue thereon will be drawn out through the single suction pipe into a cyclone filter or disposable container where it is separated from the air and deposited in a suitable removable depository. The cleansed air may be then recirculated back through the multi-jet structure to the area to be cleaned for reuse therein.

BRIEF DESCRIPTION OF THE DRAWINGS

The above and other objectives of the invention will become apparent from the following description taken in connection with the accompanying drawings, wherein.

DESCRIPTION OF THE PREFERRED EMBODIMENTS

Figure 1:
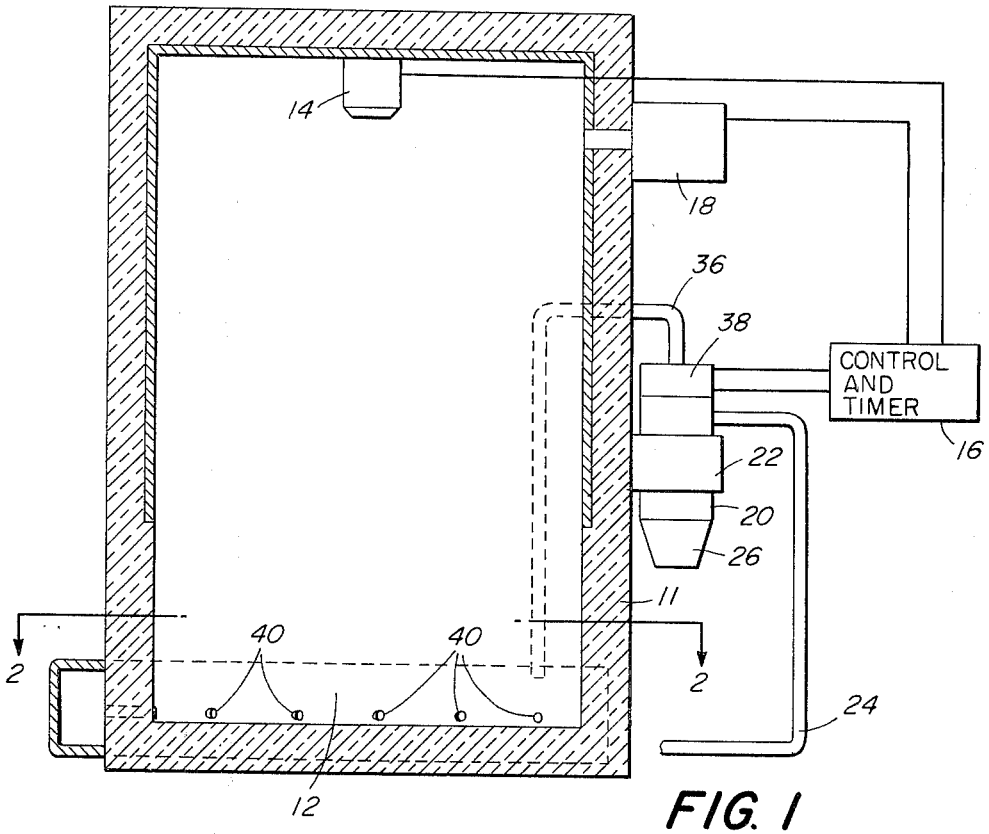
FIG. 1 is a schematic illustration of the invention showing an incinerator in vertical section.

Referring more particularly to the drawings, there is shown in FIG. 1 an incinerator 10 which may be, for example, the type shown and described in U.S. Pat. No. 3,776,148. The incinerator 10 is schematically illustrated as including firewall 11 defining a trash chamber 12, and a burner 14 which may be of the liquid-fueled or electric type. Not shown are other compartments or chambers, such as afterburner, flue, etc., and for further details reference may be made to said patent.

A control system 16 including a sequence timer is connected to the incinerator components for initiating operation of the burner 14 in any desired manner, and also for controlling automatically an air recirculating pump 18, including means for initially delaying combustion pending preheating of the afterburner. The control and timer is a well-known type similar to those on washers and other appliances. Therefore, details of this component are omitted here.

In accordance with this invention an automatic ash removal system is provided for removing any residual ash which remains after an incineration cycle has been completed. It has been found that the ash resulting from efficient and complete burning in an incinerator of the type, for example, as shown in the aforementioned copending application, will be a very light, dry, particulate matter, biologically inert and nonodorous. This residue accrues in extremely small amounts due to the extremely efficient combustion of the trash in the chamber 12 as well as of combustion products therefrom.

Figure 2:
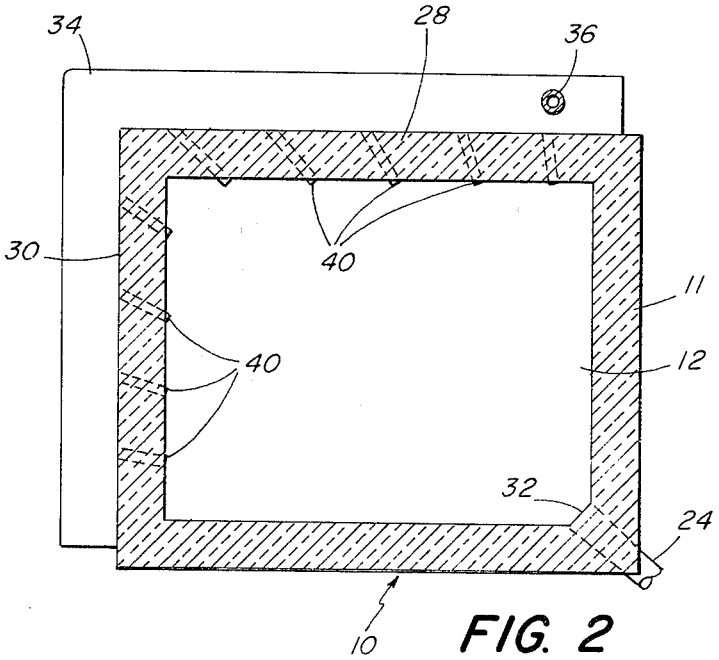
FIG. 2 is a horizontal sectional view of the invention taken substantially on line 2—2 of FIG. 1 looking in the direction of the arrows.

The ash removal system shown in FIG. 1 includes a cyclone filter 20 which is supported as by bracket 22 or the like on or adjacent to the outer wall of the incinerator 10. A suction pipe 24 has one end connected to the cyclone filter and its other end projects through the wall of the firebox 11 and terminates at one inner corner near the floor thereof as seen in FIG. 2.

At the bottom of the cyclone filter 20 is a suitable removable container 26 which serves to collect residue from the trash chamber 12 which is drawn into the cyclone filter 20 through pipe 24.

Located preferably on the outside of two walls 28 and 30 opposite the corner containing the suction inlet 32 is a continuous plenum or manifold 34 which is connected to the upper end of cyclone filter 20 by a pipe 36. A suitable fan device 38 of a conventional nature is mounted on the top of the cyclone filter 20 as a pump to force air into the plenum 34 and to draw it out of the bottom of the firebox 12, as is well known.

The plenum 34 is provided with a number of small pipes of jets 40 which extend through the firewalls 28 and 30 and project slightly into the firebox 12 just above the bottom thereof. Thus, air in the plenum 34 is forced through the jets 40 into the firebox 12.

Figure 3:
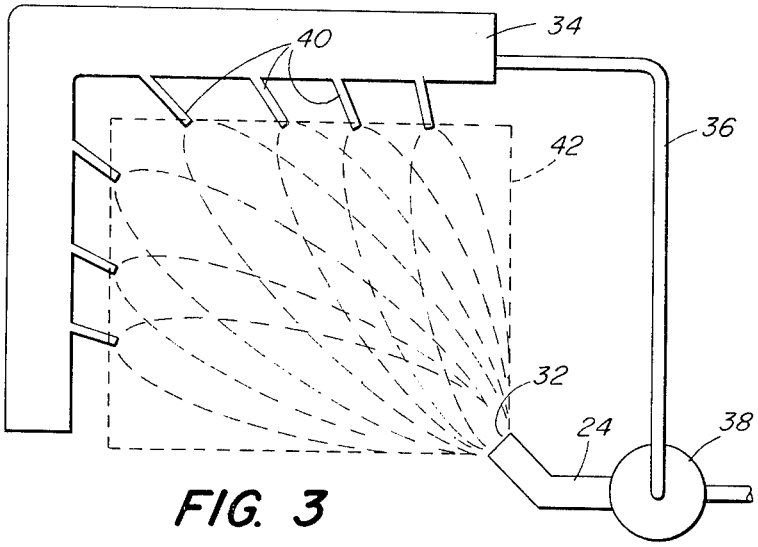
FIG. 3 is a diagrammatic illustration of the vacuum system of the invention.
Figure 4:
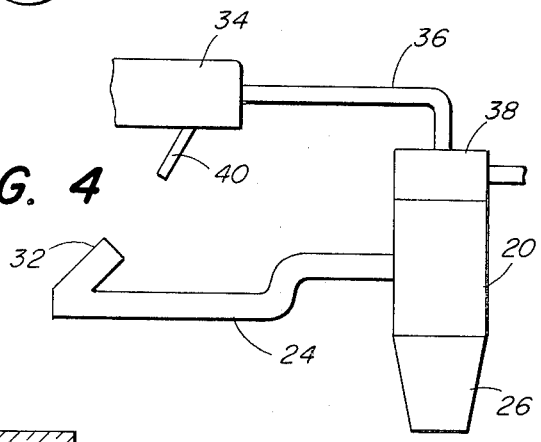
FIG. 4 is another diagrammatic illustration of the vacuum system of the invention.

In accordance with this invention, the multiplicity of jets 40 are arranged to sweep substantially the entire floor of the firewall since each jet is individually directed toward the inlet 32 of suction pipe 24. Referring to FIG. 3, it will be seen that the jets 40 create a sweeping pattern so that substantially all of the floor area 42 is swept by moving air which gathers the residue in the firebox. This residue-containing air is then collected at the inlet opening 32, which is consequently large enough to receive relatively large masses of residue, and is then drawn into the cyclone filter 20 through the pipe 24. From this it will be seen that all available kinetic energy provided by the blower 38 is used to move material in the direction of the suction pipe. Within the cyclone filter the air is swirled in the known manner so as to eventually deposit the residue in the removable container 26, while the cleansed air is returned to the plenum 34 via pipe 36.

Figure 5:
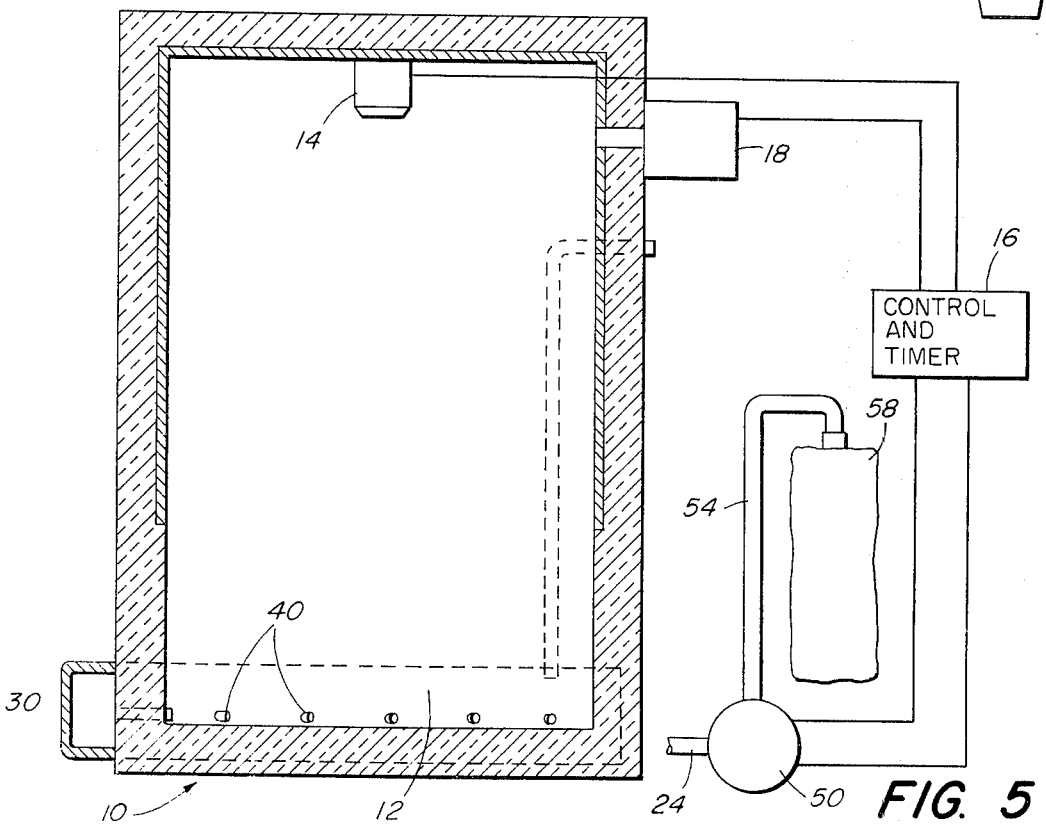
FIG. 5 is a view similar to FIG. 1 showing a second embodiment of a vacuum system utilizing the invention.

In some applications it may be desired to employ an open circuit system. Such a system is shown in FIG. 5 as applied to the incinerator 10. In this case the ash removal system includes an air compressor 50 similar, for example, to those used in relatively powerful vacuum cleaners. Compressor 50 is connected to one end of the suction pipe or conduit 24 which has its other end terminating within the firebox 12.

The opposite side of the compressor 50 is connected by a pipe 54 to a dust-impervious bag 58 or the like. Bag 58 is adapted to be connected at one end directly to the exhaust or suction pipe 24. An opening or pipe 60 connects the interior of the incinerator with the external atmosphere. Thus, when the compressor 50 is operated, air will be drawn through pipe 60 into the incinerator and thence into the trash chamber 12. This air will pick up the residue in the chamber and will be drawn out into bag 58 through suction pipe 24 where it will be deposited. The filtered air passing out of the bag 58 may then be exhausted into the atmosphere.

In the embodiment of FIG. 5 it is to be understood that the inlet end of the suction pipe 60 and the jets 40 will all be arranged as in the FIG. 2 embodiment so that substantially the entire floor surface of the trash chamber 12 will be swept by air currents flowing from the jets into the suction pipe.

It is to be understood that in the FIG. 1 structure the cyclone filter 20 may be replaced by a filter bag, in which case the bag will be located in an air-tight canister (not shown) in order to provide a closed circuit system. Also, although air jets are shown disposed on two sides only of the apparatus, they may be located otherwise so as to direct separate air streams to a single suction outlet which may be positioned in the middle of the floor of the firebox, for example.

From the foregoing it will be apparent that a novel automatic vacuum cleaning system for apparatus such as incinerators has been provided in accordance with the objectives of this invention. It will also be apparent that various other modifications and changes in the structures shown and described may be made by those skilled in the art without departing from the spirit of the invention as expressed in the accompanying claims. Therefore, all matter shown and described is to be interpreted as illustrative and not in a limiting sense.

What is claimed is:

1. Apparatus of the character described comprising a compartment having walls defining an area for containing material to be removed, and means for removing said material from the area comprising filter means, and air circulating means for directing a plurality of streams of air through the area to pick up material therein, said air circulation means comprising a plenum disposed on two adjoining walls, a plurality of jets disposed to direct respective streams of air from the plenum through said area, and suction means for receiving said streams of air and directing same to the filter means for removal of said material said suction means comprising a single outlet pipe having open end disposed in the corner of the compartment opposite the two walls carrying the plenum, and said jets extend through said walls and are all disposed to direct their respective air streams toward said corner containing the open end of the suction pipe.

2. Apparatus as set forth in claim 1 wherein said filter means comprises a cyclone filter located outside of said compartment and connected with the opposite end of said suction pipe, and said air circulation means further includes blower means operatively connected with said cyclone filter, and piping connecting said cyclone filter through the blower means to the plenum.

3. Apparatus as set forth in claim 1 wherein said filter means comprises a substantially dirt impervious air penetrable collector located outside of said compartment and connected with the opposite end of said suction pipe.

4. Apparatus as set forth in claim 3 wherein said collector is located within an air-tight canister, a compressor is positioned outside said compartment, a pipe connects said compressor with the interior of the canister, and another pipe connects the compressor with said plenum.

5. An incinerator and vacuum cleaning means therefor comprising a burning compartment having a burner therein for burning combustible products, an ash receiving area at the bottom of said compartment for reception of ash following combustion, and means for cleaning ash from said area comprising filter means, and air circulating means for directing a plurality of streams of air through the area to pick up ash therein, and suction means including a single outlet for receiving said streams of air and directing same to the filter means for removal of ash therein, said air circulation means comprising a plurality of jets disposed to individually direct respective streams of air through said area toward said suction means.

6. An incinerator as set forth in claim 5 wherein said ash receiving area is defined by walls, and said air circulation means includes a plenum mounted on said walls and a plurality of air jets connected with said plenum and disposed to individually direct respective streams of air through said area to said suction means.

7. An incinerator as set forth in claim 6 wherein said ash receiving area is enclosed by four walls, said plenum is disposed on two adjoining walls, said suction means comprises a pipe having one open end disposed in the corner of the area opposite the two walls carrying the plenum, and said jets are all disposed to direct their respective air streams toward the corner containing the open end of the suction pipe.

8. An incinerator as set forth in claim 7 wherein said filter means comprises a cyclone filter located outside said walls and connected with the opposite end of said suction pipe, and the air circulation means further comprises blower means operatively connected with said cyclone filter, and piping connecting said cyclone filter through the blower means to the plenum.

* * * * *